United States Patent [19]

McKann et al.

[11] Patent Number: 4,819,383

[45] Date of Patent: Apr. 11, 1989

[54] DOOR SYSTEM WITH INTERLOCKING PANELS

[75] Inventors: H. Smith McKann; Wendel W. Haney, both of Fredericksburg, Va.

[73] Assignee: General Products Company, Inc., Fredericksburg, Va.

[21] Appl. No.: 197,956

[22] Filed: May 24, 1988

[51] Int. Cl.[4] ..... E06B 3/00

[52] U.S. Cl. ..... 49/501; 49/503; 49/506; 52/805

[58] Field of Search ..... 49/501, 503, 506; 52/802, 805, 809

[56] References Cited

U.S. PATENT DOCUMENTS

| | | | |
|---|---|---|---|
| 537,337 | 4/1895 | Bobb | 52/805 |
| 993,483 | 5/1911 | Wege | 52/805 |
| 1,015,212 | 1/1912 | Schaffert | 52/805 |
| 1,848,715 | 3/1932 | Hart | 52/805 |
| 2,664,182 | 12/1953 | Williams | 52/805 |
| 3,333,385 | 8/1967 | King | 52/805 |
| 3,413,762 | 12/1968 | Baudé et al. | 49/501 |
| 3,455,078 | 7/1969 | Brown | 49/503 |
| 3,512,305 | 5/1970 | Multer | 49/503 |
| 3,633,312 | 1/1972 | Yeager et al. | 49/503 |
| 3,786,613 | 1/1974 | Shepheard | 52/802 |
| 4,327,535 | 5/1982 | Governale | 49/501 |
| 4,438,597 | 3/1984 | Maggart | 49/501 |
| 4,589,240 | 5/1986 | Kendall | 52/805 |

*Primary Examiner*—Philip C. Kannan

*Attorney, Agent, or Firm*—Roylance, Abrams, Berdo & Goodman

[57] ABSTRACT

A door is formed by latch and hinge panels which can be attached without fasteners or welding. Each of the panels is formed of a unitary piece of sheet metal and includes a rectangular face member, a side flange extending substantially perpendicularly from the face member along one of its side edges, a first latch formed along a free lateral edge of the side flange remote from the face member, a second latch formed along the opposite side edge of the face member and end flanges extending substantially perpendicularly from the face member along the end edges. The first latch of each panel is secured to the second latch of the other panel such that the panels are secured and form the door, with latches being located at diametrically opposite corners of the door. An insulating core member is located between the panels.

20 Claims, 3 Drawing Sheets

FIG. 4.
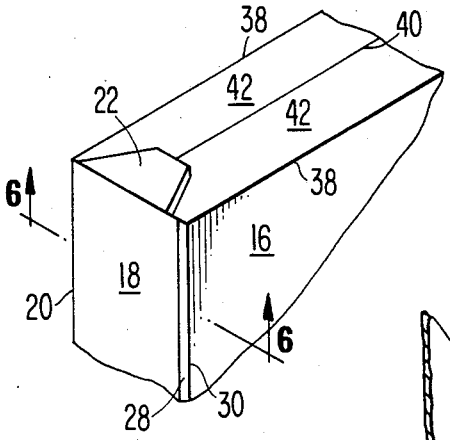
FIG. 5.
FIG. 6.
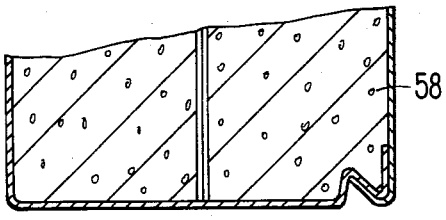
FIG. 7.
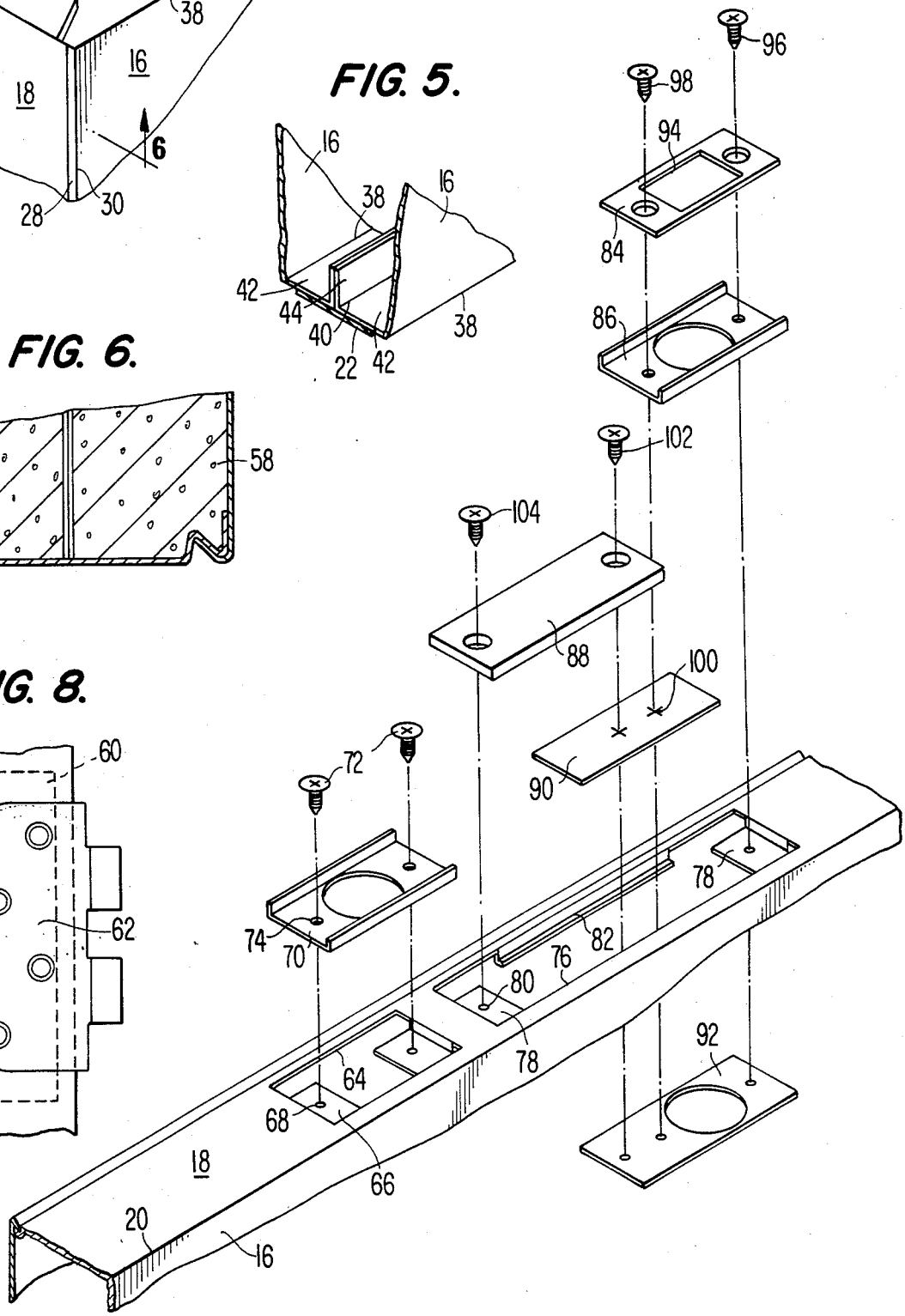
FIG. 8.
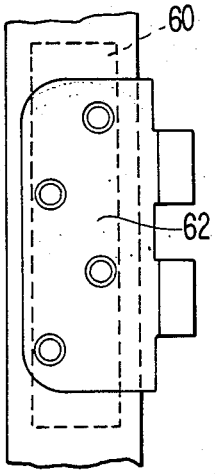

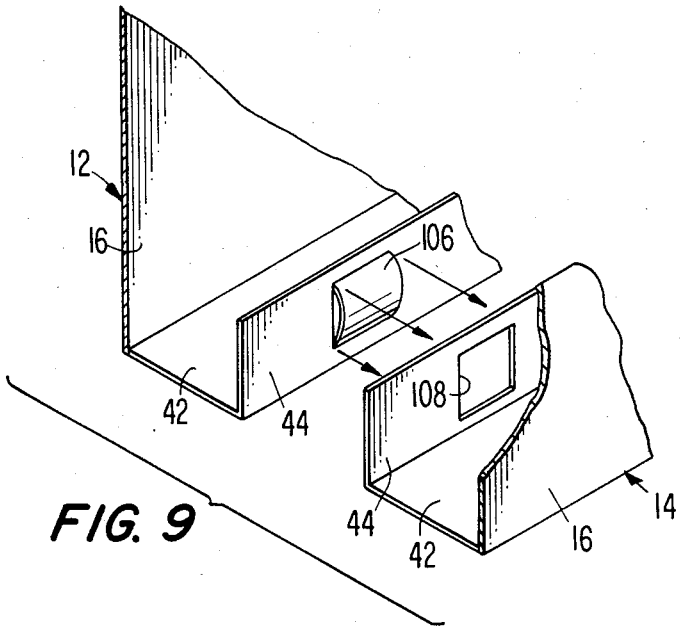
FIG. 9
FIG. 10.
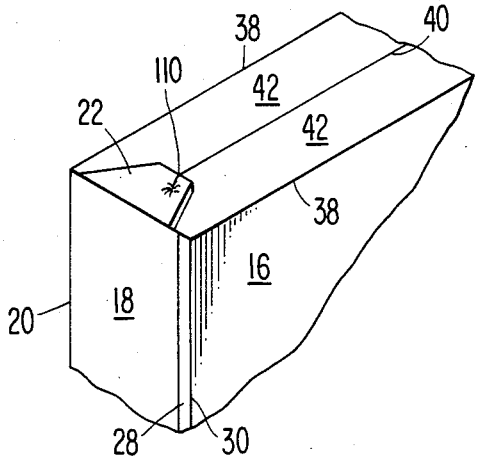

DOOR SYSTEM WITH INTERLOCKING PANELS

FIELD OF THE INVENTION

The present invention relates to a door having two panels which can be secured together to form a door from only two metal pieces and without fasteners or welding. The door is formed by bending sheet metal into two panels which can be snapped together. The assembled panels define an internal cavity into which foam material is injected.

BACKGROUND OF THE INVENTION

Steel doors are usually formed with edge parts or channels. The face plates or panel members of the door are secured by fasteners, such as rivets or screws, or by spot welds. By constructing the metal door in this manner, the door must be painted after completing construction to cover the fasteners, welds and other structural connecting parts. Because of the conventional connection of the various parts, pr-coated or prepainted sheet metal could not be employed.

Metal doors have been formed by a pair of telescoping parts locked together by the snap action of latches, avoiding the use of bolts, rivets and welding. However, these constructions require differently shaped members for the front and back panels. Additionally, the side edges of the door are interrupted by the latches such that a continuous, smooth metal surface is not provided for the dead bolt and latch preparations or for the hinges. Further, an effective mechanism for properly aligning the panels and maintaining them in an aligned position is not provided. Typical examples of these conventional metal doors are disclosed in U.S. Pat. Nos. 1,848,715 to Hart and 4,589,240 to Kendall.

SUMMARY OF THE INVENTION

An object of the present invention is to provide a door which can be easily constructed of two similar panels of pre-coated or pre-painted sheet metal.

Another object of the present invention is to form a door which can be completely assembled without the use of fasteners or welding.

A further object of the present invention is to provide a door and a method of making the door which has an efficient construction, which can be easily manufactured, and is rugged.

The foregoing objects are obtained by a door having first and second panels and a core member located between the panels. Each panel is formed of a unitary piece of sheet metal, including a rectangular face member with opposite side and end edges, a side flange extending substantially perpendicularly from the face member along one of the side edges, a first latch means located along a free lateral edge of the side member remote from the face member, a second latch means formed along the other side edge of the face member, and end flanges extending substantially perpendicularly from the face member along the end edges.

The first and second latch means of the first panel engage the second and first latch means, respectively, of the second panel to secure the panels and to form the door. Each side flange can have a width substantially equal to the thickness of the door being formed such that the latch means are located at diametrically opposed corners of the door. In this manner, the door can be formed without fasteners or welding using prepainted or coated material. Additionally, the side edges of the door are free of breaks facilitating the assembly of the hinge and of the latches on the opposite side edges of the door.

Tabs can extend from the longitudinal ends of the side flanges. These tabs are folded against and overlie the end flanges to align the panels vertically and horizontally relative to each other, to maintain them in their aligned position, and to seal the door corners from leakage of the injected foam core material.

The foregoing objects are also obtained by a method of forming a door comprising the steps of producing first and second panels with each panel being formed by cutting and bending a unitary piece of sheet metal. Each panel is produced by forming a rectangular face member with opposite side and end edges, bending a side flange to a position substantially perpendicular to the face member along one of the side edges, with the side flange having a width substantially equal to the door thickness, forming a first latch means along a free lateral edge of the side flange remote from the face member, forming a second latch means along the other side edge of the face member, and bending end flanges to positions substantially perpendicular to the face member along the end edges.

These panels are superposed and engaged such that the first and second latch means of the first panel are secured with the second and first latch means, respectively, of the second panel assembling the panels and forming the door. The latch means are located at diametrically opposite corners of the door. After assembly of the panels, a core member is formed between the panels by injecting foam material between the assembled panels.

This method provides a simple and effective mechanism for producing a sturdy door. By snapping the panels together, pre-coated or pre-painted sheet metal can be employed. Additionally, only one type of panel need be formed, with variations only being subsequently made in the panels for hinge preparations or latch-dead bolt preparations, and for location of the door knob opening.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 4 is a partial perspective view illustrating the corner of a door according to the present invention;

FIG. 5 is a partial perspective view, with portions broken away, of a door according to the present invention;

FIG. 6 is a bottom plan view in section taken along line 6—6 of FIG. 4;

FIG. 7 is an exploded perspective view of the latch preparation for the door of the present invention;

FIG. 8 is a partial side elevational view illustrating the hinge preparation according the present invention;

FIG. 9 is an enlarged, partial, exploded perspective view, with portions broken away, of a door with an additional feature according to the present invention; and FIG. 10 is a partial perspective view illustrating the corner of a door with another additional feature according to the present invention.

DETAILED DESCRIPTION OF PREFERRED EMBODIMENT

Figure 1:
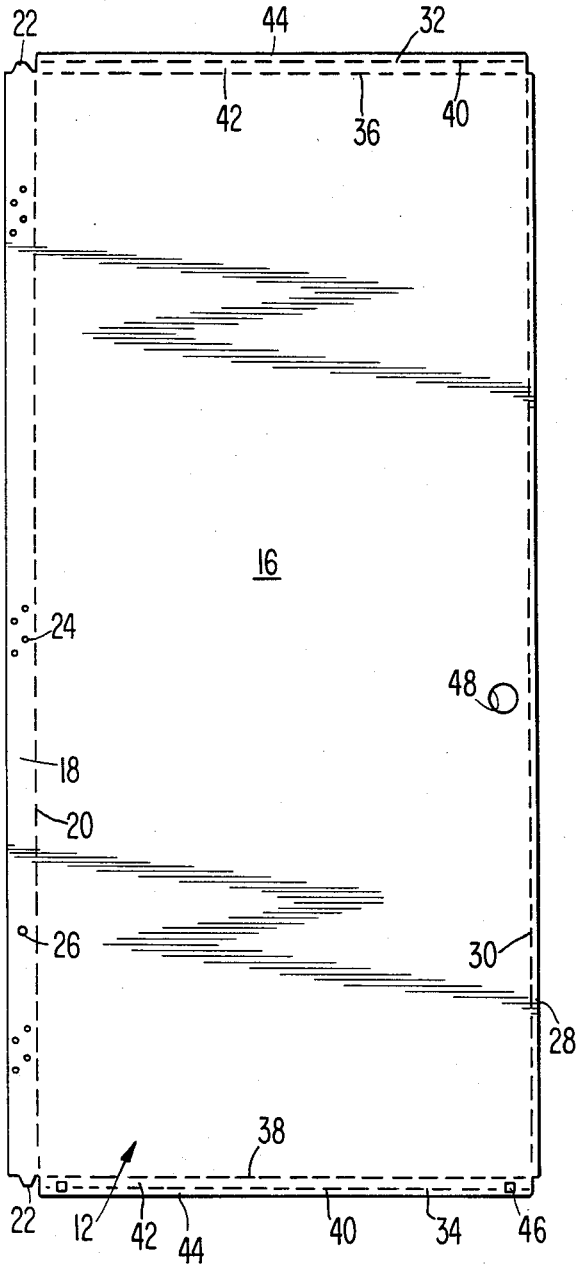
FIG. 1 is a top plan view of a hinge panel blank for a door according to the present invention.

The present invention relates to a door which is pivotly mounted along one side edge to a frame and has a latch mechanism and a door knob adjacent its opposite side edge. The door is formed from a hinge panel 12 illustrated in FIG. 1 and a latch panel 14 illustrated in FIG. 2. The two panels are secured together to form the door and entrap a plastic foam core therebetween.

Each of the panels 12 and 14 is formed of a unitary, single piece of sheet metal. Each panel has a rectangular, planar face member 16. A side flange 18 extends along the entire length of one of the longer sides of rectangular face member 16 and is connected to face member 16 by a fold line 20. A pair of trapezoidal shaped tabs 22 extend longitudinally outwardly from the longitudinal ends of side flange 18. Three sets of bores 24 are provided to form hinge preparations. Located between the two lower most hinge preparations is an opening 26 for injecting foam into the assembled door.

The opposite longitudinal side of face member 16 has a laterally extending lip 28 extending along the entire length of the face member. The lip is connected to the face member along a fold line 30.

Upper end flange 32 and lower end flange 34 extend respectively from the upper and lower end edges of face member 16. Upper end flange 32 is connected to face member 16 along fold line 36. Lower end flange 34 is connected to face member 16 along fold line 38. Each of the end flanges is divided by a fold line 40 to an inner or first portion 42 and an outer or second portion 44.

Rectangular openings 46 are formed in lower end flange 34 adjacent to its longitudinal ends and spanning fold line 40. Openings 46 are provided to permit suspending of the panel for coating or other treating prior to bending to form the door.

Latch panel 14 is substantially identical to hinge panel 12. The only differences are locations of knob openings 48, and the latch preparation 50 and dead bolt preparation 52 on side flange 18 of latch panel 14 and the hinge preparations on side flange 18 of hinge panel 12. Latch and dead bolt preparations are described in detail hereinafter. The descriptions of the features of latch panel 14 which are identical to hinge panel 12 are not repeated.

Figure 2:
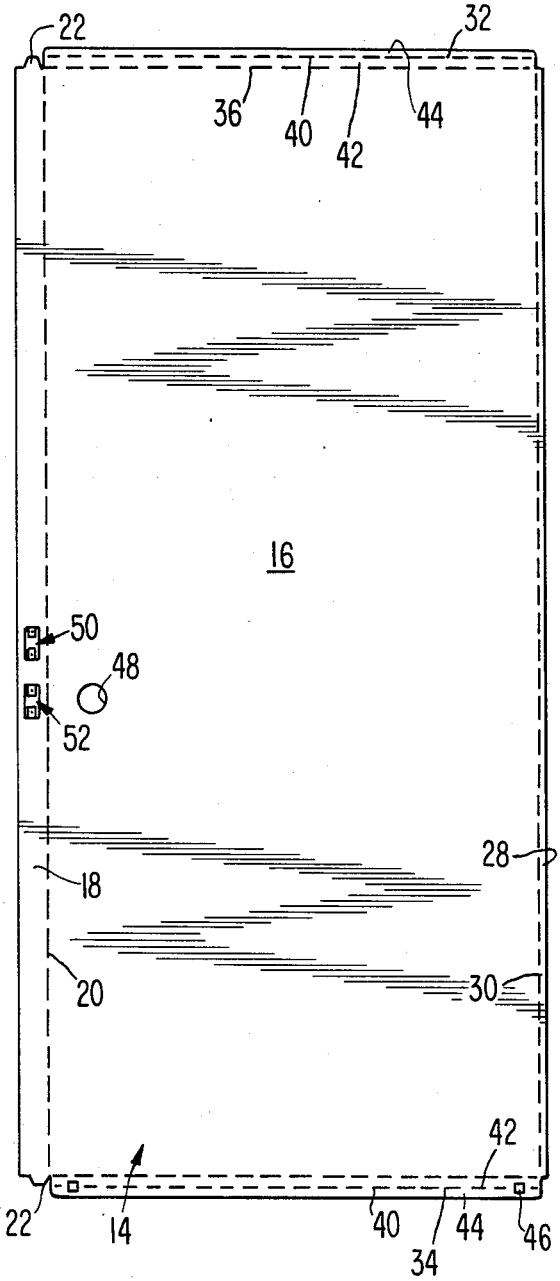
FIG. 2 is a top plan view of latch panel blank for a door according to the present invention.

Identical panels are initially formed with the peripheral configuration illustrated in FIGS. 1 and 2. Alternate panels are then stamped with the details for the hinge preparation or for the latch preparation to form them as hinge panels or latch panels. The panels are then folded or bent to the configuration illustrated in FIG. 3.

In the folded configuration, side flange 18 is folded about line 20 to a position in which it is substantially perpendicular to face member 16. The free edge portion of side flange 18, i.e., that portion of the side flange which is remote from face member 16, is bent into the configuration of a latch 54. Latch 54 is formed as Z-shaped fold in the free edge portion of side flange 18 located laterally outside of the tabs 22, and the hinge preparation or the latch dead-bolt preparation. This provides a continuous, uninterrupted planar section of the side flange which facilitates the formation of the hinge and latch-dead bolt preparations.

A mating latch 56 is formed along the opposite lateral side of face member 16. Latch 56 is formed by bending lip 28 about line 30 such that it is oriented at an acute angle relative to face member 16. The angles of the Z-folded arrangement forming latch 54 and the angle between lip 28 and face member 16 can be between about 45° and about 60°.

Figure 3:
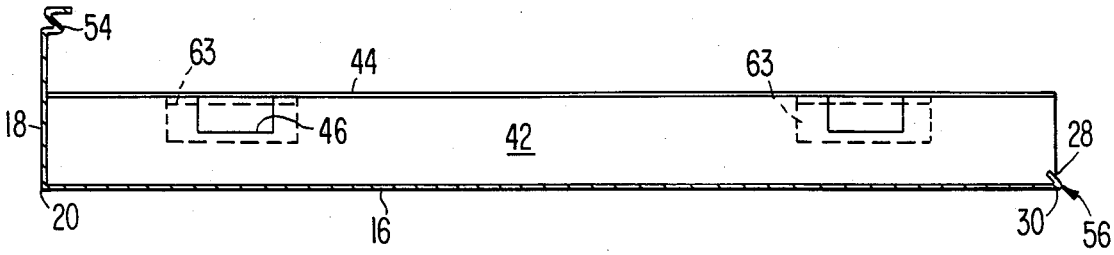
FIG. 3 is an end elevational view in section of a formed panel for forming a door according to the present invention.

The end flanges 32 and 34 are folded to the configuration illustrated in FIGS. 3 and 5. The folds define angles of 90° and are formed along lines 38 and 40 such that inner portions 42 are perpendicular to face panel 16, while outer portions 44 are perpendicular to inner portions 42 and parallel to face member 16. This provides a generally U-shaped configuration with face member 16, inner portion 42 and outer portion 44.

After each panel has been bent to the folded configuration, the two panels are superposed such that latch 54 of each panel is adjacent to lip 28 of the other panel. The panels are then pressed together such that each lip 28 overlies the respective latch 54 as illustrated in FIG. 6 to secure the panels together.

In this secured position, outer portions 44 of the lower end flanges 34 and of the upper end flanges 32 abut one another. The inner end portions of the end flanges at each door end are coplanar as illustrated in FIGS. 5 and 6.

After these panels have been attached in this manner, tabs 22 are folded against and overlie inner portions 42 of the end flanges to ensure proper alignment of the two panels, as illustrated in FIG. 4. Additionally, the folding of tabs 22 against the end flanges closes any space which may exist between the end flanges and the side flanges at the door corners, sealing such corners to prevent leakage of foam material injected between the panels.

The construction of the door is completed by mounting the assembled panels 12 and 14 in a suitable fixture and injecting foam, for example polyurethane, into the hollow cavity defined between the two panels through opening 26. After the foam material is cured, the door is completed except for minor finishing operations. The injected foam material surrounds the end flange portions 44 to prevent separation of the door between the end flanges of the respective panels. Additionally, the foam provides a outward force against the panels tending to keep the latch arrangement formed by the Z-shaped fold latch 54 and lip 28 engaged.

During the initial forming of the panels, hinge reinforcement plates 60 are located over the areas in which bores 24 for the hinges are formed. This facilitates and improves the integrity of the attachment of hinge plates 62 as illustrated in FIG. 8.

To prevent leakage of the injected foam material through openings 46, tape 63 is applied to the inner surface of the lower end flanges 34 over these openings. The tape seals the opening against the leakage of the core material as illustrated in FIG. 3.

The details of the latch preparation 50 and the dead bolt preparation 52 are illustrated in FIG. 7. The latch preparation is formed in side flange 18 between fold line 20 and the Z-shaped fold of latch 54. Latch preparation 50 comprises an opening 64 in side flange 18. Portions of the side flange are shaped and bent to provide L-shaped end flanges 66 with bores 68. The end side flanges 66 support a face plate filler 70 which is secured to the flanges by screws 72. Screws 72 pass through openings 74 in filler 70 and threadedly engage bores 68.

The dead bolt preparation 52 comprises an elongated opening 76 in side flange 18. The ends of the elongated opening have L-shaped end flanges 78. End flanges 78 have bores 80. The longitudinal sides of the opening are provided with narrow elongated L-shaped side flanges 82.

A dead bolt strike plate 84 is mounted on a face plate filler 86. A dead bolt cover 88 and a cardboard filler plate 90 are also mounted in elongated opening 76 adjacent the strike plate. A multi-dead bolt plate 92 abuts against the inside surfaces of side flanges 82. By suitably adapting the size of cover 88 and locating the various parts of the dead bolt preparation in various locations, the dead bolt opening 94 can be located in various positions along the length of the elongated opening 76 to adapt to the dead bolt system employed.

A typical arrangement is illustrated in FIG. 7. A screw 96 passes through openings in striker plate 84, filler plate 86 and threadedly engages bores in flange 78 and multi-dead bolt plate 92. Another screw 98 passes through aligned openings in strike plate 84, plate filler 86, slit 100 in filler 90 and threadedly engages a bore in plate 92. A third screw 102 passes through an opening in cover 88, a slit in plate 90 and threadedly engages a third bore in plate 92. A fourth screw 104 passes through the other opening in cover 88 and threadedly engages bore 80 in lower end flange 78. In this manner, a dad bolt arrangement can be simply provided, adapted to various locking systems, and adjusted along the length of opening 76.

To further ensure that hinge panel 12 and latch panel 14 are held in the proper relationship, the additional retaining means illustrated in FIG. 9 can be provided. The retaining means comprise at least one projection 106 formed in an outer portion 44 of hinge panel 12 and at least one mating opening 108 in an outer portion 44 of latch panel 14, equally spaced from the respective edges of the panels. Projection 106 is formed by making two parallel slits in the respective outer portion 44 and then deforming the material between the slits outwardly into a partially cylindrical shape with an axis of curvature parallel to the fold lines between inner portions 42, outer portions 44 and face member 16. Opening 108 is rectangular and sized to receive projection 106 with a close fit when outer portions 44 abut to relatively locate and retain panels 12 and 14. By preventing lateral shifting of panels 12 and 14, the door edges formed by side flanges 18 are held square with the door faces formed by face members 16.

As an alternative to or in combination with the additional retaining means of FIG. 9, a staking operation can be performed on each tab 22, forming an indentation 110, as illustrated in FIG. 10. The tabs of one panel 12 or 14 are staked to the adjacent inner portion 42 of the other panel 14 or 12, after the two panels are assembled and tabs 22 have been folded over as illustrated in FIG. 10. These other retaining means engage the two panels and prevent lateral shifting of the panels to hold the door edges square with the door faces.

Although particular embodiments have been chosen to illustrate the invention, it will be understood by those skilled in the art that various changes and modifications can be made therein without departing from the scope of the invention as defined in the appended claims.

What is claimed is:

1. A door, comprising:

first and second panels, each of said panels being formed of a unitary piece of sheet metal and including a rectangular face member with opposite side and end edges, a side flange extending substantially perpendicularly from said face member along one of said side edges, said side flange having a width substantially equal to a thickness of the door, a first latch means formed along a free lateral edge of said side flange remote from said face member, a second latch means formed along the other side edge of said face member, and end flanges extending substantially perpendicularly from said face member along said end edges;

said first and second latch means of said first panel engaging said second and first latch means, respectively, of said second panel to secure said panels and form the door, said latch means being located at diametrically opposite corners of the door; and a core member located between said panels.

2. A door according to claim 1 wherein each said second latch means comprises a lip directly connected to the respective face member other side edge along a fold line and extending at an acute angle relative to the respective face member.

3. A door according to claim 1 wherein each said side flange comprises tabs extending from longitudinal ends thereof, said tabs being folded against and overlying said end flanges.

4. A door according to claim 1 wherein said side flange of said first panel comprises hinge preparation means between said first latch means and said face member thereof.

5. A door according to claim 1 wherein said side flange of said second panel comprises latch preparation means between said first latch means and said face member thereof.

6. A door according to claim 1 wherein each said first latch means comprises a Z-shaped fold in the free lateral edge of each said side flange.

7. A door according to claim 6 wherein each said second latch means comprises a lip directly connected to the respective face member other side edge along a fold line, extending at an acute angle relative to the respective face member, and overlying one of said Z-shaped folds.

8. A door according to claim 1 wherein one of said end flanges extends form each said end edge of each said face member.

9. A door according to claim 8 wherein each said end flange comprises a first portion extending directly from and perpendicular to the respective face member, and a second portion extending from a free edge of said first portion and parallel to the respective face member, the respective second portions being in surface to surface contact, the respective first portions being substantially coplanar.

10. A door according to claim 9 wherein a projection extends from at least one of said second portions; and a mating opening in an abutting one of said second portions receives said projection to prevent lateral shifting of said first and second panels.

11. A door according to claim 9 wherein each said side flange comprises tabs extending from longitudinal ends thereof, said tabs being folded against and overlying said first portions of said end flanges.

12. A door according to claim 11 wherein said tabs are staked to adjacent first portions of the other panel.

13. A door, comprising:

first and second panels, each of said panels being formed of a unitary piece of sheet metal and including a rectangular face member with opposite side and end edges, a side flange extending substantially perpendicularly from said face member along one of said side edges, said side flange having tabs extending from longitudinal ends thereof, a first latch means formed along a free lateral edge of said side flange remote from said face member, a second latch means formed along the other side edge of said face member, and end flanges extending substantially perpendicularly from said face member along said end edges, said tabs being folded against and overlying said end flanges;

said first and second latch means of said first panel engaging said second and first latch means, respectively, of said second panel to secure said panels and form the door; and a core member located between said panels.

14. A door according to claim 13 wherein one of said end flanges extends form each said end edge of each said face member.

15. A door according to claim 14 wherein each said end flange comprises a first portion extending directly from and perpendicular to the respective face member, and a second portion extending from a free edge of said first portion and parallel to the respective face member, the respective second portions being in surface to surface contact, the respective first portions being coplanar.

16. A door according to claim 15 wherein said tabs ar folded against and overlie said first portions of said end flanges.

17. A method of forming a door, comprising the steps of:

producing first and second panels, each of said panels being formed by cutting and bending a unitary piece of sheet metal and including forming a rectangular face member with opposite side and end edges, bending a side flange to a position substantially perpendicularly of the face member along one of the side edges, said side flange having a width substantially equal to a thickness of the door, forming a first latch means along a free lateral edge of the side flange remote from the face member, forming a second latch means along the other side edge of the face member, and bending end flanges to position substantially perpendicularly to the face member along the end edges;

superposing the panels and engaging the first and second latch means of the first panel with the second and first latch means, respectively, of the second panel to secure the panels and form the door, the latch means being located at diametrically opposite corners of the door; and forming a core member between the panels by injecting foam material between the assembled panels.

18. A method according to claim 17 wherein tabs integrally connected to said side flanges and extending from longitudinal ends of the side flanges are folded against and overlie the end flanges.

19. A method according to claim 17 wherein openings formed in said end flanges are taped closed on inside surfaces of the end flanges to seal the openings against leakage of core material.

20. A method according to claim 17 wherein end flanges are formed on each face member end edge with each end flange having a first portion extending directly from and perpendicular to the respective face member, and a second portion extending from a first portion free edge and parallel to the respective face member, the respective second portions being placed in surface to surface contact and surrounded by the foam material.

* * * * *